United States Patent [19]

Whistler

[11] Patent Number: 4,947,716

[45] Date of Patent: Aug. 14, 1990

[54] PUNCH AND DIE SYSTEM

[75] Inventor: S. Arthur Whistler, Orchard Park, N.Y.

[73] Assignee: S. B. Whistler & Sons, Inc., Akron, N.Y.

[21] Appl. No.: 338,863

[22] Filed: Apr. 17, 1989

Related U.S. Application Data

[62] Division of Ser. No. 92,311, Sep. 1, 1987, Pat. No. 4,843,931.

[51] Int. Cl.[5] ..... B26F 1/14

[52] U.S. Cl. ..... 83/98; 83/138; 83/140; 83/588; 83/639.1; 83/685; 83/698; 83/955

[58] Field of Search ..... 83/98, 99, 684–689, 83/926 H, 146, 639, 639.1, 140, 138, 588, 955

[56] References Cited

U.S. PATENT DOCUMENTS

| | | | |
|---|---|---|---|
| 2,341,187 | 2/1944 | Menger et al. | 83/98 X |
| 2,386,290 | 10/1945 | Brooks | 83/686 |
| 3,236,130 | 2/1966 | Robert | 83/98 |
| 3,580,120 | 5/1971 | Adams et al. | 83/98 |
| 4,418,596 | 12/1983 | Garrocho | 83/98 |
| 4,628,780 | 12/1986 | Hicks | 83/99 |

*Primary Examiner*—Hien H. Phan

*Attorney, Agent, or Firm*—Bean, Kauffman & Spencer

[57] ABSTRACT

A punch and die system is disclosed as comprising punch and die templets serving to positionally locate punch and die assemblies relative thereto solely adjacent the region at which punching of a workpiece occurs in combination with guide assemblies for positionally locating the punch and die templets one to the other. The punch and die assemblies are designed to utilize interchangeable punch guide and die members and in a preferred construction a punch element is removably attached to its associated driver and shaped to permit opposite ends thereof to be employed in the punching operation. One or more punch elements may be loosely attached to their associated drivers.

5 Claims, 4 Drawing Sheets

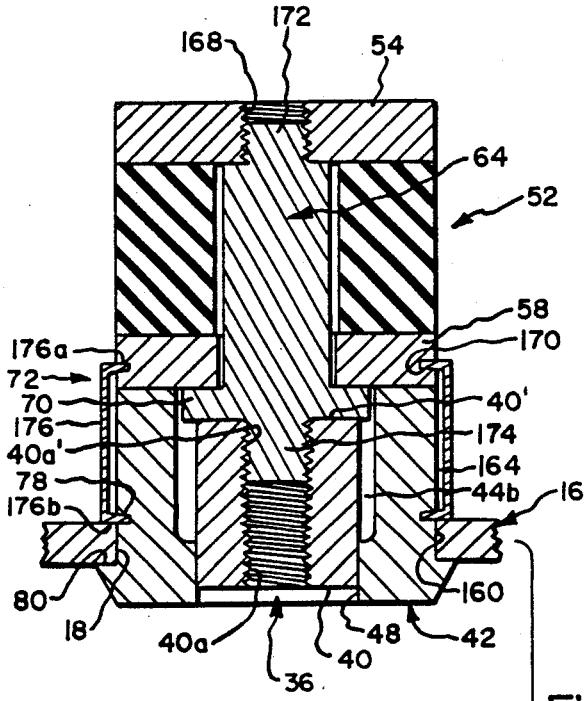
Fig. 4.
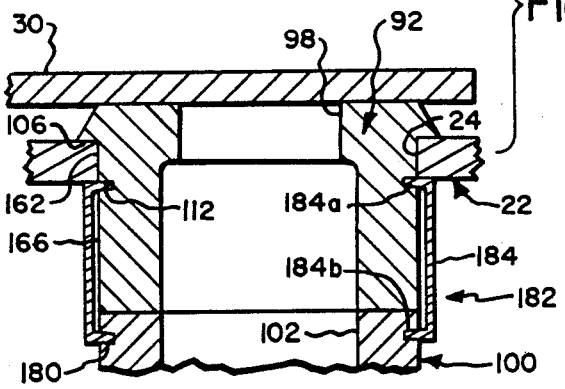
Fig. 5.
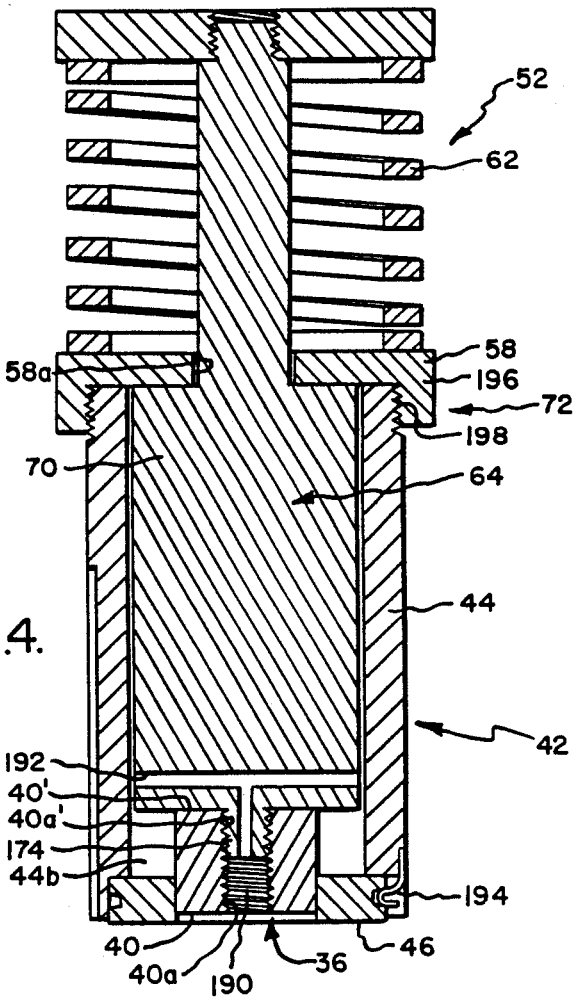
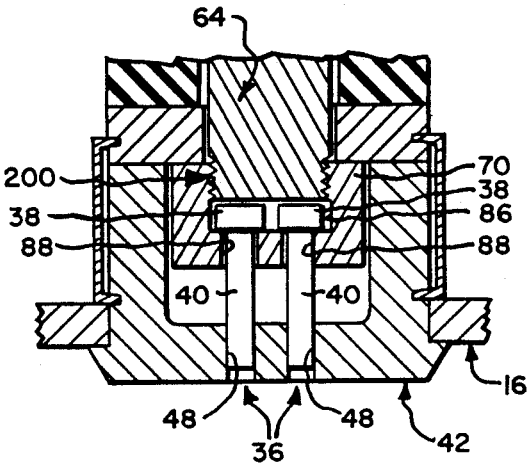
Fig. 6.
Fig. 7.
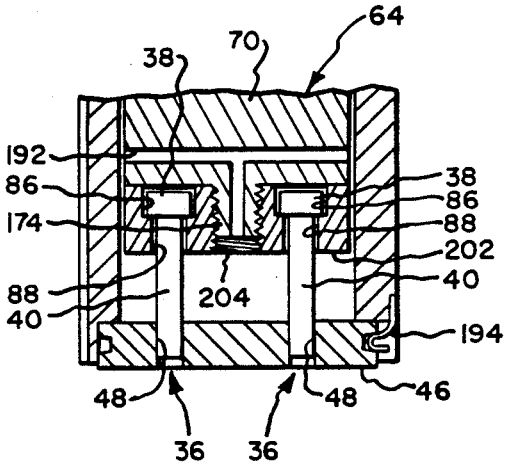

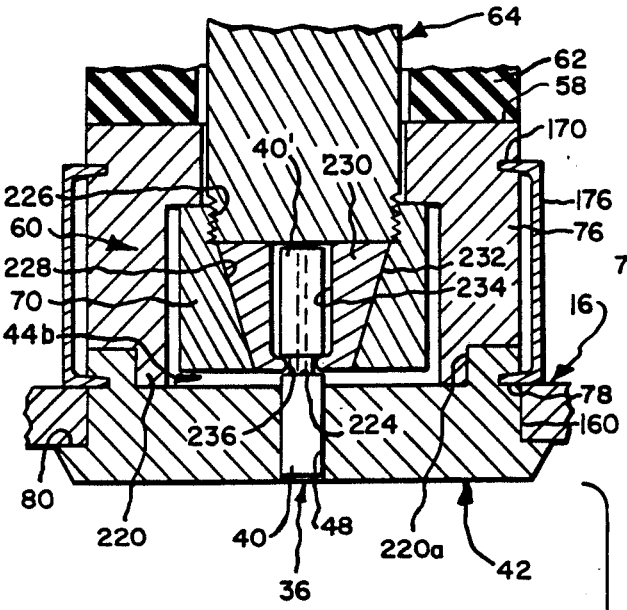
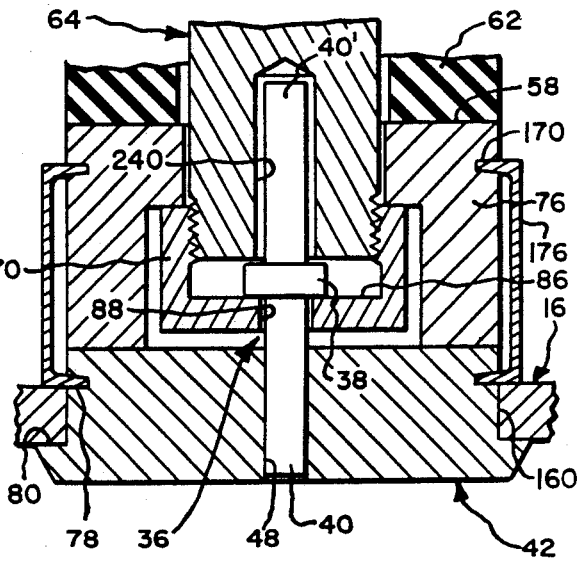
Fig. 11.
Fig. 10.
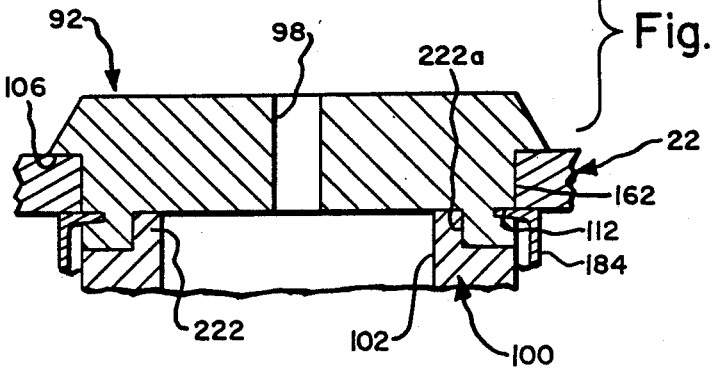
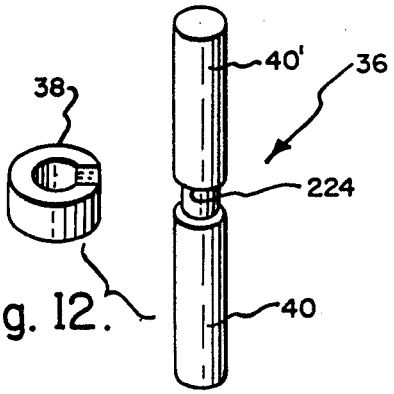
Fig. 12.
Fig. 8.
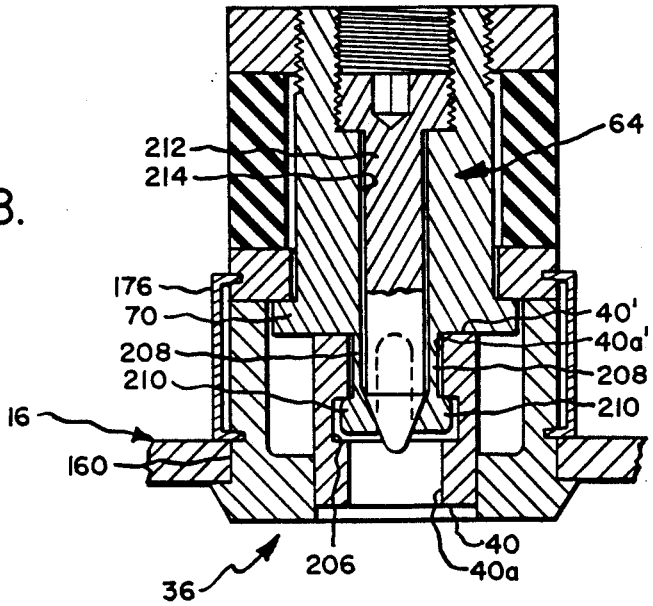
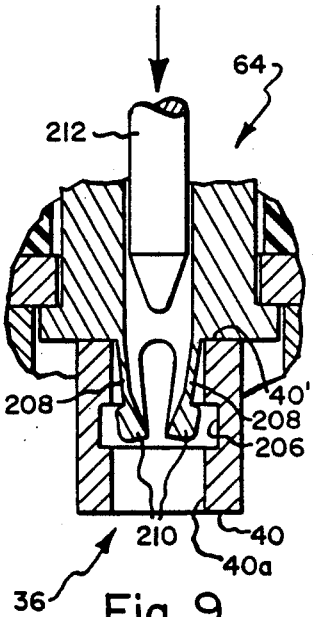
Fig. 9.

PUNCH AND DIE SYSTEM

This is a divisional of co-pending application Ser. No. 07/092,311 filed on Sep. 1, 1987, now U.S. Pat. No. 4,843,931.

BACKGROUND OF THE INVENTION

Heretofore, it has been accepted commercial practice to attach punch and die assemblies to punch and die shoes of a die set adapted to be assembled out of a press and then positioned between the ram and bed or bolster of the press. Accurate positioning of the tip of a punch, which is associated with a punch assembly, relative to a punch tip receiving opening of a die member, which is associated with a die assembly, is effected by providing a guide member for the punch tip and positioning such guide member and the die member within aligned locating openings defined by punch and die templets, which are in turn maintained in accurate alignment during punching operations by guide assemblies associated with the die set. Reference may be had to U.S. Pat. 4,104,941 for a more complete description of a die set of this construction.

It has also been proposed to provide punch and die sets of the general type described above, wherein one or both of the punch and die shoes are eliminated from the die set, whereby to greatly reduce the overall weight thereof, and in this connection reference may be made to U.S. Pat. Nos. 2,296,136; 2,393,962; 2,395,083 and 2,553,615. Also, in U.S. Pat. No. 2,296,136 use appears to be made of guide and die members of like construction adapted to be threadably connected to adjacent parts of the punch and die assemblies. However, it does not appear that these systems have met with commercial acceptance.

It is also known to form a punch from multiple parts including a punch driver and a punch element, which are removably coupled as by forming the parts with a screw threaded coupling or by providing a separate clamping nut to clamp an enlarged head of the punch element against a threaded end of the punch driver, as in U.S. Pat. No. 856,110.

SUMMARY OF THE INVENTION

The present invention is directed towards improvements in a punch and die system of the type employing punch and die templets to positionally locate punch and die assemblies relative thereto solely adjacent the region at which punching of a workpiece occurs and guide assemblies serve to positionally locate the punch and die templets one relative to the other.

More specifically, the present invention contemplates the provision of punch and die assemblies and guide assemblies of improved construction, which are designed to facilitate manufacture thereof and to simplify use of a "shoeless" punch and die system under commercial operating conditions.

The present invention additionally contemplates improved multi-part punch constructions, wherein punch elements are formed and fixed to a punch driver in a manner allowing opposite ends of such punch elements to be used for punching of a workpiece. The punch elements may be loosely attached to a punch driver in a manner serving to reduce to a minimum manufacturing tolerances required to be maintained in fabricating the punch elements.

BRIEF DESCRIPTION OF THE DRAWINGS

The nature and mode of operation of the present invention will now be more fully described in the following detailed description taken with the accompanying drawings wherein:

FIG. 4 is a partial vertical sectional view taken through punch and die assemblies of alternative construction;

FIG. 5 is a vertical sectional view taken through a punch assembly of a second alternative construction;

FIG. 6 is a vertical sectional view showing a modified punch construction adapted for use in the punch assembly of FIG. 4;

FIG. 7 is a vertical sectional view showing a modified punch construction adapted for use in the punch assembly of FIG. 5;

FIG. 8 a vertical sectional view showing a further modified punch construction adapted for use in the punch assembly of FIG. 4, FIG. 9 is an enlarged view of a portion of the punch construction shown in FIG. 8, but in punch element release condition;

FIG. 10 is a vertical sectional view showing a modified form of the punch and die assemblies of FIG. 4;

FIG. 11 is a vertical sectional view showing an additional modified form of punch assembly; and FIG. 12 is an exploded view of a modified punch element;

DETAILED DESCRIPTION

Figure 1:
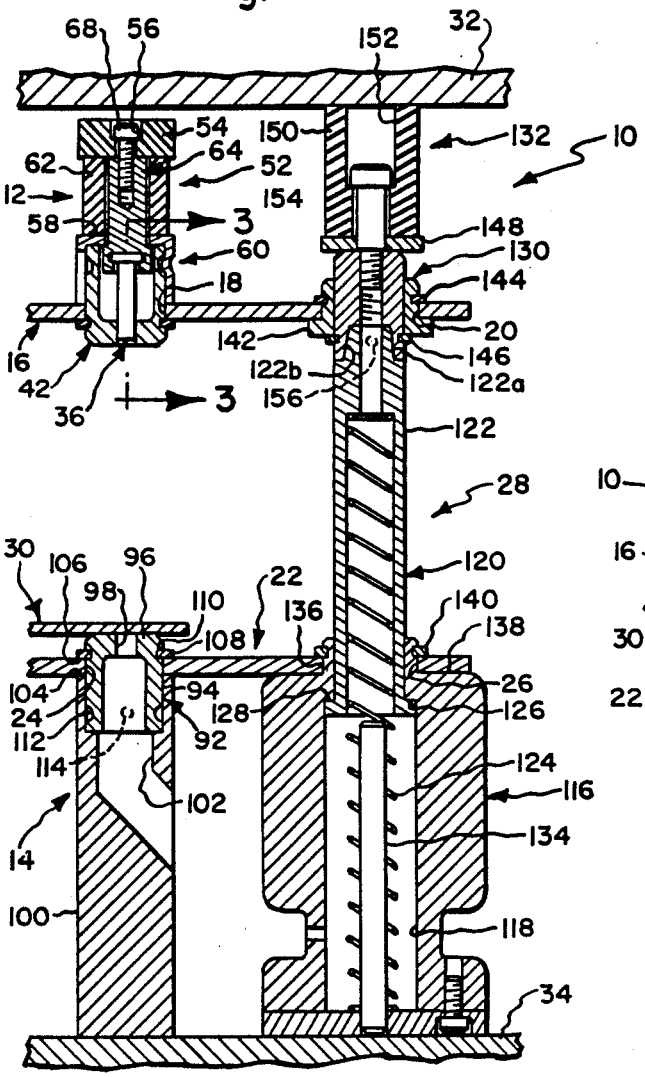
FIG. 1 is a partial vertical sectional view taken through the punch and die system of the present invention, as viewed in a press open condition.
Figure 2:
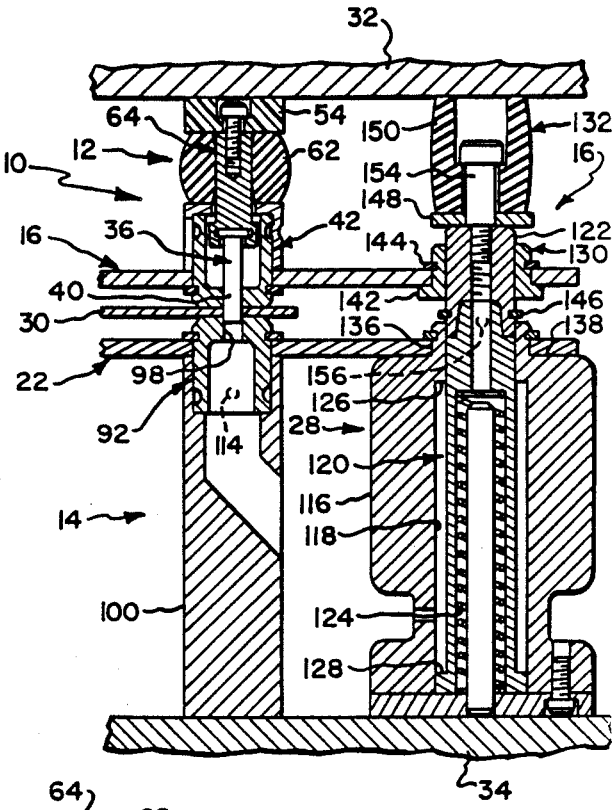
FIG. 2 is a view similar to FIG. 1, but as viewed in a press closed condition.

Reference is now made to FIGS. 1 and 2, wherein a first form of the present punch and die system is designated as 10, and shown as generally including: a punch assembly 12; a die assembly 14; a punch templet 16 having a locating opening 18 serving to positionally locate the punch assembly relative thereto and a guide opening 20; a die templet 22 having a locating opening 24 serving to positionally locate the die assembly relative thereto and a guide opening 26; and a guide assembly 28 cooperating with guide openings 20 and 26 to maintain locating openings 18 and 24 in accurate vertical alignment, during punching of a workpiece 30 placed between the punch and die templets. Guide assembly 28 also serves to interconnect punch templet 16 to die templet 22, so as to allow system 10 to be inserted as a unit within a suitable press having a ram 32 and bed or bolster 34 adapted to be moved relative to one another between press open and closed conditions depicted in FIGS. 1 and 2, respectively, for purposes of effecting punching of workpiece 30. A vertically opening press is depicted in the drawings, and thus such terms up and down or upper and lower are used to facilitate description of the invention, but such terms should not be considered as limiting in that it is contemplated that system 10 may be employed in horizontally opening presses and moreover that the system may be inverted relative to the position shown in FIG. 1.

The number, placement and construction of the punch and die assemblies will depend on the number, placement and shape of holes desired to be punched in any given workpiece, whereas the number and placement of the guide assemblies will depend on the shape and size of the punch and die templets. The punch and die templets will typically be formed of metal and be of similar and preferably identical thickness.

Figure 3:
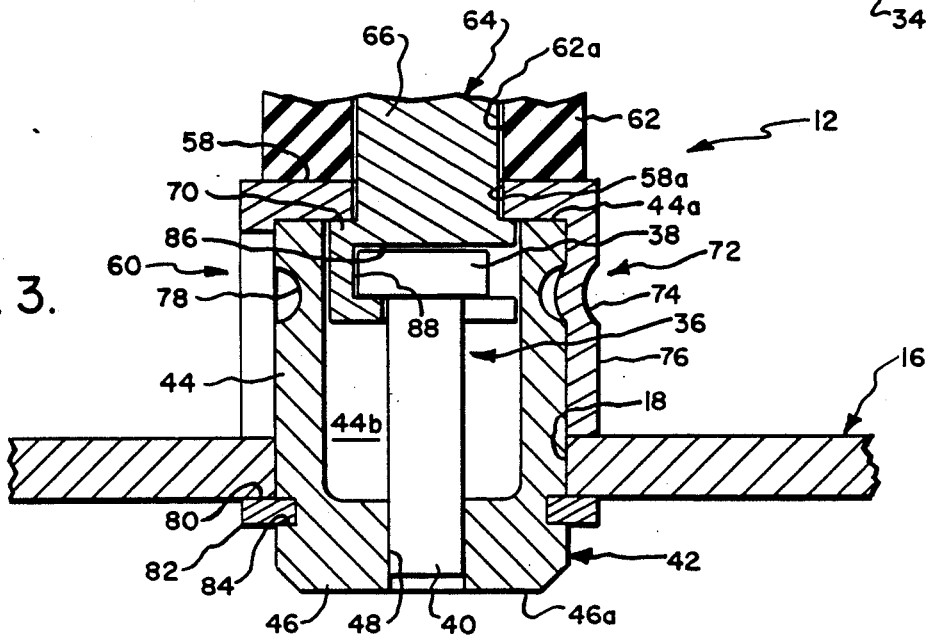
FIG. 3 is a sectional view taken generally along the line 3—3 in FIG. 1.

Punch assembly 12 is shown in FIGS. 1–3 as including a punch element 36 formed with a head portion 38 and a punching tip defining portion 40 formed for example as a shank having a uniform cross-sectional configuration throughout its length; a generally cup-shaped guide member 42 having a cylindrical side wall portion 44 and an end wall portion 46 formed with a guide opening 48 sized to slidably receive tip portion 40 and arranged to extend through its end surface **46*a*, which is disposed essentially parallel to the opposite end surface 44*a* defined by the side wall portion; a resilient stripper device 52 having an upper end or first constraint in the form of a cap plate 54 formed with a stepped diameter bore 56, a lower end or second constraint in the form of the end wall portion 58 of an inverted, generally cup-shaped cap 60, and a resiliently deformable spring device, such as a cylindrically shaped resiliently deformable sleeve 62 of rubber, polyurethane or the like; a punch driver 64 having an upper or first end 66, which is removably attached to plate 54 by a bolt 68 and arranged to extend downwardly through an opening in the stripper device defined by an inner wall 62*a* of sleeve 62 and a central aperture 58*a* formed in cup end wall 58, and an enlarged lower or second end 70, which is loosely received within a cavity 44*b* peripherally bounded by an inner surface of side wall portion 44 and connected to punch element 36 by means to be described; a latch device 72 defined for example by dimples or projections 74 extending inwardly from a resiliently deformable, depending side wall 76 of cap 60 for removable receipt within an annular groove or recess 78 formed in an outer surface of side wall portion 44; and an abutment or ledge 80, defined for example by a C-shaped ring 82 snap fit received within an annular recess 84 formed in the periphery of guide member 42 adjacent end wall portion 46**.

By viewing FIGS. 1–3, it will be understood that resiliently deformable sleeve 62 tends to retain enlarged lower end 70 of driver 64 in seated or abutting engagement with the lower surface of cap end wall portion 58; and that latch device 72 tends to releasably retain the opposite or free end surface **44*a* of side wall portion 44 in seated or abutting engagement with the lower surface of cap end wall portion 58 and cooperates with abutment 80 to releasably maintain guide member 42 within locating opening 18. The shape of opening 18 and thus the external shape of guide member 42 are a matter of choice, but preferably same are of cylindrical configuration, and conventional retainer means, not shown, are employed to rotatably fix or locate the guide member and thus guide opening 48 relative to templet 16 whenever such guide opening and punch tip 40** are of other than circular cross-sectional configuration.

Again referring to FIG. 3, it will be seen that punch element 36 and driver 64 are releasably and loosely coupled or connected by forming enlarged lower end 70 with a transversely opening recess 86, which is sized to loosely and slidably receive head portion 38, and with a transversely opening through opening 88, which communicates with recess 86 and is sized to loosely and slidably receive the upper end of the shank portion defining punch tip 40.

Die assembly 14 is shown in FIGS. 1 and 2 as including a generally cup-shaped die member 92 having a side wall portion 94 sized to be slidably received within locating opening 24 of die templet 22 and an end wall portion 96 formed with an opening 98 for receiving punch tip 40; and a mounting base 100, which is adapted to freely upstand from bed 34 and formed with an upwardly opening, stepped diameter slug discharge passage 102 having an enlarged upper end sized to removably, slidably support die member 92 and an upwardly facing, annular support surface 104 arranged to underengage with the die templet. Opening 98 has the same shape as guide opening 48, but is formed slightly larger in order to provide for required "die clearance", which typically varies from 5% to 30% of the thickness of workpiece 30.

Further, die member 92 is shown as carrying an abutment or ledge 106 defined for instance by a resiliently deformable C-shaped ring 108 snap-fitted within an annular groove 110 and as having an annular groove or recess 112 adapted to receive suitable latch device, such as a screw retainer 114, for purposes of retaining the die assembly in assembled condition, wherein support surface 104 cooperates with ledge 106 to retain die member 92 within locating opening 24. In accordance with a presently preferred form of the invention, die member 92 is identical in size and shape to punch guide member 42 except for sizes of their respective punch receiving openings, so as to allow same to be alternately connected to base 100 and stripper device 52 by latch devices 114 and 72 depending upon the punch size to be employed. In other words, a given guide member may be used with a given die member for a given size punch, but such given guide member may also be employed as a die member for the case of a slightly smaller size punch and such given die member may be employed as a guide member for the case of a slightly larger size punch.

Guide assembly 28 is shown in FIGS. 1 and 2 as generally comprising a base 116, which is adapted to upstand from press bed 34 and formed with a vertically upwardly opening, stepped diameter bore or guide opening 118; a stepped diameter guide pin 120, which is slidably supported within bore 118 and provided with a reduced diameter end portion 122 arranged to project above base 116; a spring 124 tending to bias guide pin 120 upwardly into a fully extended position shown in FIG. 1 as being defined by stop surfaces 126 and 128 formed by the base and guide pin, respectively; a guide ring 130, which is slidably supported on end portion 122 and slidably received within guide opening 20 of punch templet 16; a spring device 132 fixed to the free upper end of end portion 122; and a pin 134 arranged within bore 118 for positioning/aligning spring 124 relative thereto. The upper end of base 116 is formed with an annular locating surface 136 slidably received within guide opening 26 of die templet 22, a support surface 138 arranged to provide underlying support for the die templet and stop means 140 preferably in the form of a snap ring for removably retaining the die templet in engagement with the support surface. Guide ring 130 is shown in the drawings as being provided with an integrally formed first stop 142 arranged to engage the lower surface of punch templet 16 and a removable second stop 144 preferably in the form of a C-shaped snap ring arranged to engage the upper surface of the punch templet. Guide ring 130 and thus punch templet 16 are normally supported or positioned relative to guide pin 120 by positioning or stop means 146 preferably in the form of a C-shaped snap ring removably fixed to end portion 122 for underengagement with the guide ring. Movement of guide ring 130 vertically relative to positioning means 146 is limited by the presence of suitable means, such as a stop washer or plate 148, which preferably comprises a part of spring device 132 and is spaced from the positioning means through a distance at least equal to the sum of the axial dimension of the guide ring and the thickness of workpiece 30. Spring device 132 preferably includes a resiliently deformable body 150, which is formed of rubber, polyurethane or the like and provided with a stepped diameter bore opening 152 adapted to receive a bolt 154 extending downwardly through washer 148 for threaded receipt within the upper end of guide pin 120. Preferably, the upper end of body 150 of spring device 132 is disposed vertically above cap plate 54 of punch assembly 12 when guide pin 120 is in its extended position shown in FIG. 1.

Guide pin end portion 122 may be divided into first or lower and second or upper axially aligned parts having mating frusto-conical end surfaces **122*a* and 122*b*, respectively, which are releasably maintained in engagement by suitable means, such as a set screw 156. Positioning means 146 and thus guide ring 130, punch templet 16 and spring device 132 are carried by the upper part of end portion 122, such that system 10 is divided into vertical halves which may be removably connected together, as required to facilitate assembly of the system and installation/removal thereof relative to a press. It may also be desirable to provide the lower extent of the external surface of the lower part of end portion 122 with a slight taper or reduced diameter, so that such lower part forms a close sliding fit with base 116 only during a portion of the travel of the end portion adjacent its retracted position shown in FIG. 2** with a view towards reducing wear inducing contact between such lower part and base, during the remaining portion of movement of the end portion where perfect alignment of the punch and die assemblies is not required.

In system 10, as thus far described, punch assembly 12 of guide member 42 within locating opening 18, die assembly 14 is positionally located relative to die templet 22 by receipt of die member 92 within locating opening 24, and locating openings 18 and 24 are positioned in vertical alignment by receipt of guide ring 130 and base locating surface 136 within punch and die templet guide openings 20 and 26, respectively, whereby to accurately align guide opening 48 of the guide member with opening 98 of the die member. The slide connection of punch tip 40 with guide opening 48, together with the loose connection of the punch tip with the remaining portions of punch assembly 12, assures accurate alignment of the punch tip with opening 98 of die member 92 and minimizes any bending force which the punch tip might otherwise be exposed to during a punching operation, due to any non-parallelism existing between punch templet 16, cap plate 54 and press ram 32. Thus, accurate punching of holes in workpiece 30 is assured and the tendency for punch tip 40 to chip or otherwise fail is substantially reduced. Moreover, manufacture is greatly simplified, since there is no need to maintain accurate concentricity between punch tip 40 and head portion 38 of punch element 36, or between such head portion and driver 64 or between such driver and guide member 42. Manufacture and stocking of components of system 10 is also simplified by forming guide member 42 and die member 92 as interchangeable parts, which may be selectively, removably attached to the punch and die assemblies.

In the operation of system 10, its elements are assembled and then placed within a press to assume the position shown in FIG. 1, and workpiece 30 is then placed on die members 92 and arranged in a desired position established by conventional gage devices, not shown. Upon operation of the press, press ram 32 descends into engagement with spring device(s) 132 to effect contraction of guide pin 120 against the bias of spring 124 and resultant lowering of punch templet 16 until movement of the latter is interrupted by engagement of guide member 42 with the upper surface of workpiece 30. After movement of punch templet 16 is arrested, continued closing movements of ram 32 serves to drive guide pin 120 into its fully retracted position shown in FIG. 2, which is defined by the guide pin bottoming out within base bore opening 118, and then to effect compression of spring device 132 and stripper device 52 incident to which punch tip 40 is driven through workpiece 30 for receipt within die member opening 98.

Upon the return of press ram 32 to its initial position, spring device 132 and stripper device 52 are first permitted to expand incident to which punch tip 40 is withdrawn into the confines of guide member 42, whereafter punch templet 16 is engaged by positioning means 146 and finally returned to its initial position under the bias of spring 124.

Reference is now made to FIG. 4, wherein are illustrated alternative punch and die assemblies adapted for use in the overall system shown in FIGS. 1 and 2. In this arrangement, guide member 42 and die member 92 are of like construction, but differ from those previously described in that ledges 80 and 106 are defined by integrally formed enlargements of these members and in that annular grooves or recesses 78 and 112 are spaced from such ledges through a distance corresponding to the thickness of punch and die templets 16 and 22. Preferably, the outer surfaces of members 42 and 92 are of stepped diameter so as to provide locating surfaces 160 and 162, which are slide fit received within locating openings 18 and 24, respectively, and clearance surfaces 164 and 166, which are adapted to be freely or loosely passed through the locating openings in order to facilitate assembly of the members relative to the punch and die templets. If desired, the outer surfaces of members 42 and 92 illustrated in FIGS. 1–3 may also have stepped diameters to facilitate assembly thereof.

The punch assembly shown in FIG. 4 also differs from that of FIGS. 1–3 in that stripper device 52 has its upper constraint 54 provided with a threaded opening 168 and its lower constraint 58 formed as a washer having an annular recess or groove 170; driver 64 has its upper end formed with a threaded boss 172 received within opening 168 and its lower end provided with a threaded boss 174; punch element 36 is in the form of a body having its opposite end portions defining punch tips 40,40' of identical size and cross-sectional configuration and a pair of axially aligned and preferably interconnected threaded openings **40*a*,40*a*' extending one through each of such end portions for alternate attachment to driver boss 174; and latch device 72** is in the form of a separate resiliently deformable C-shaped clip 176 having locking projections or ribs 176*a* and 176*b* arranged to extend radially inwardly from adjacent its marginal edges for removable receipt within recesses 170 and 78, respectively. The punch element of FIG. 4 possesses the advantage that each of its ends may be used for punching purposes, so as to double the useful life of the punch element. Moreover, by positionally locating the punch element solely by means of guide opening 48 of guide member 42 and by loosely fitting enlarged lower end 70 of driver 64 within guide member cavity 44*b*, manufacture of the punch element and the driver is facilitated, due to the lack of requirement for concentricity between punch tips 40,40' and threaded openings 40*a*,40*a*', and between the external surfaces of the driver and the axis of boss 174.

Again referring to FIG. 4, it will be seen that the die assembly shown therein also differs from that described with reference to FIGS. 1 and 2 in that the diameter of base 100 may be reduced to correspond essentially to the diameter of clearance surface 166, since it is no longer required to provide a surface for supporting die templet 22 or to support die member 92 within the upper end of its slug discharge passage 102. This is accomplished by providing base 100 with an annular recess or groove 180 and by providing the die assembly with a latch device 182, which serves both to support die templet 22 and to maintain die member 92 and the base engaged in end-to-end aligned and abutting relationship. Latch device 182 is shown as being in the form of a separate resiliently deformable C-shaped clip 184 having locking projections or ribs 184*a* and 184*b* arranged to extend radially inwardly from adjacent its marginal edges for removable receipt within recesses 112 and 180, respectively. Preferably, latch device 182 is identical to latch device 72.

Reference is now made to FIG. 5, wherein is illustrated a further modified form of the punch assembly, which is primarily adapted for use in turret tooling, but whose structural features may be adapted for use in modifying the punch assemblies of FIGS. 1–4. This punch assembly is similar to that of FIG. 4 with regard to the overall design of driver 64 and punch element 36, except that mounting openings 40*a* and 40*a*' are preferably joined to define a first passage 190 and driver 64 is provided with a second passage 192 extending through boss 174 to place passage 190 in flow communication with guide member cavity 44*b*, whose unoccupied interior volume defines at least in part a source of fluid under pressure, which may if desired correspond essentially to atmospheric pressure. In the illustrated construction, cavity 44*b* is shown as communicating with the atmosphere via opening 58*a* of second constraint 58 of stripper device 52, when the driver is disengaged from the second constraint during that portion of operation when punch tip 40 or 40' is being stripped from work-piece 30, but atmospheric communication would not appear to be necessary when the overall volume of passages 190 and 192 and the fluid source defined in the illustrated construction by the unoccupied portion of cavity 44*b*, opening 58*a* and the interior of stripper device 52 is substantially larger than the volume approximately defined by multiplying the area of a slug to be punched from workpiece 30 by the length of the stroke of punch tip 40 or 40' relative to guide member 42. This arrangement is intended to prevent the build-up or to at least reduce the effect of a vacuum condition otherwise tending to occur within the opening of the die member at the interface between the lower face of the punch tip and a slug punched from the workpiece, which would otherwise tend to pull such slug upwardly out of the die member, particularly under high speed operating conditions.

This general construction may also be used in a conventional turret tooling installation of the type wherein guiding of a punch element is effected by close fitting sliding engagement between the lower end 70 of punch driver 64 and the interior surface or cavity bounding wall of guide wall portion 44, by arranging passage 192 to extend vertically within the driver and have its upper end placed in communication with the upper end of cavity 44*b* in an area above that at which guiding of the punch driver is effected or directly to the atmosphere. Also, if desired, a fluid source formed separately from the punch assembly may be employed to supply passage 192 with a fluid under a pressure which exceeds atmospheric pressure.

The punch assembly of FIG. 5 differs from those previously described in that guide member 42 is provided with separately formed side wall and end wall portions 44 and 46, which are removably connected by a suitable retainer, such as a spring clip 194; latch device 72 is defined by providing second constraint 58 with an internally threaded annular flange 196 adapted to removably threadably engage with the externally threaded upper end 198 of side wall portion 44; and stripper device 52 is provided with a metal coil type compression spring 62, which affords flow communication between second constraint opening 58*a* and the atmosphere. In a turret tooling installation, the external surface of side wall portion 44 would typically serve as a locating surface for the punch assembly and end wall portion 46 would be removably fixed with respect to the side wall to prevent transverse movement therebetween.

FIG. 6 illustrates a punch assembly similar to that shown in FIG. 4, except that such assembly is particularly adapted to incorporate two or more punch elements 36 of the type illustrated in FIGS. 1–3. In this construction, the enlarged lower end 70 of driver 64 is separately formed as an upwardly opening, cup-shaped mounting member, which is removably secured to the driver by a threaded coupling 200 and formed with a through opening or bore 88 sized to loosely receive shank or punching tip portion 40 of each punch element 36. Openings 88 communicate with the interior of the mounting member or recess 86, which is transversely sized to loosely receive head portions 38 of the punch elements. Through openings 88 are approximately aligned with a like number of guide openings 48 formed in guide member 42, which is intended to serve as the sole means for locating and guiding punch elements 36. It is intended that the mounting member not be threaded onto driver 64 sufficiently to clamp the upper surfaces of head portions 38 firmly thereagainst, since this would interfere with any transverse movement of punch elements 36 within recess 86 and through openings 88 required to align and permit insertion of punch tip portions 40 within guide openings 48. An abutment, not shown, may be provided for purposes of limiting the threading of the mounting member onto the driver.

FIG. 7 illustrates a punch assembly similar to that shown in FIG. 5, except that such assembly is particularly adapted to incorporate two or more punch elements 36 in a manner somewhat similar to that described with reference to FIG. 6. In this construction, the lower end of enlarged portion 70 of driver 64 is fitted with a separate plate 202 formed with a centrally located opening 204 threaded to removably receive boss 174 and an appropriate number of separately formed recesses 86 and communicating openings 88 approximately aligned with guide openings 48 formed in guide member end wall portion 46. The dimensions of recesses 86 and through openings 88 are sufficient to insure that punch elements 36 are loosely received therewithin, as required to permit alignment and insertion of punch tip portions 40 within guide openings 48.

Reference is now made to FIGS. 8 and 9, which illustrate a punch assembly similar to that shown in FIG. 4, except as regards the construction of punch element 36 and the mode of attachment thereof to driver 64. In this arrangement, mounting openings 40*a* and 40*a*′ of punch element 36 are formed as communicating bore openings and a mounting recess 206 is arranged to communicate therewith at a point essentially equidistant from end portions 40 and 40′; and enlarged end 70 of punch driver 64 carries resiliently deformable and adjacently disposed fingers 208 having latching end portions or enlargements 210 sized for removable receipt within openings 40*a* and 40*a*′ when such fingers are in a non-deformed condition shown in FIG. 9. Latching end portions 210 are sized to be loosely received within mounting recess 206 for purposes of attaching punch element 36 to driver 64 when fingers 208 are urged or forced apart into a resiliently deformed condition incident to insertion of a screw device 212 into a stepped opening 214 extending lengthwise through driver 64 in the manner shown in FIG. 8. While fingers 208 are shown as being formed integrally with driver 64, it is anticipated that same may be formed as a separate unit and suitably fixed to the driver.

Reference is now made to FIG. 10, which illustrates punch and die assemblies somewhat similar to that shown in FIG. 4, except as regards the construction of guide member 42, die member 92, punch element 36 and the mode of attaching the punch element to driver 64. More specifically, the guide and die members differ from that shown in FIG. 4 in that they are plate-like in design, wherein the overall thickness of such plate, which corresponds to end wall 46 of the guide member of FIG. 4, is made sufficient to form ledges 80 and 106, locating surfaces 160 and 162, and recesses 78 and 112. These guide and die members do not include a side wall portion, which in the case of the previously described guide member served to bound cavity 44*b*, but rather, such cavity is in this instance transversely bounded by a rigid side wall portion 76 formed integrally with second constraint 58, so as to define an inverted cup-shaped member 60. If desired, transverse movement of the guide and die members, with respect to second constraint 58 and base 100 may be positively prevented by forming side wall portion 76 and the base with inner annular lips or ribs 220 and 222 sized to be slidably received within inner recesses 220*a* and 222*a* of the guide and die members, respectively.

Punch element 36 of FIG. 10, is similar to the punch element of FIG. 4 from the standpoint that it includes opposite end portions serving to define oppositely facing punch tip portions 40 and 40′ of like size and configuration. However, in this construction, the punch element is formed with a radially outwardly opening annular mounting recess 224 arranged equidistant from such end portions. In this instance, the punch element may be connected to driver 64 by a mounting member 70, which is formed with a through opening having a threaded upper end portion 226 for removable connection to the driver and a frusto-conical lower end portion 228, and a further mounting member or collar 230 comprised of a resiliently deformable split ring or two or more arcuate cam locking elements cooperating to define a generally frusto-conical shaped outer surface 232, a generally cylindrical inner surface 234 sized to loosely receive punch tip portions 40 or 40′ and a lower annular mounting lip(s) 236 sized to be loosely received within mounting recess 224. Upon the threading of mounting member 70 onto driver 64, surfaces 228 and 232 cooperate to cam or force the upper end of member 230 into engagement with the lower surface of driver 64, as an incident to which member 230 is radially/annularly contracted to position lip(s) 236 within the confines of mounting recess 224, whereby to attach punch element 36 to the driver. The axial lengths of mounting recess 224, lip 236, member 230 and punch tip portions 40,40′ are such that punch element 36 is loosely supported in a direction extending axially of the punch assembly, whereas the transverse or radial dimensions of the mounting recess, the lip, punch tip portions and inner surface 234 are such that the punch element is loosely supported in a direction extending transversely of the punch assembly. As such, punch element 36 is relatively unconstrained by driver 64 and it is free to move relative thereto as required to permit opening 48 of guide member 42 to act as the sole guiding influence on the punch element. It will be noted that collar inner surface 234 and lip(s) 236 cooperate to define a recess and the lip(s) form a through opening functionally corresponding to recess 86 and opening 88 of the punch assembly constructions of FIGS. 1–3, 6 and 7. A particularly important advantage of this construction is that the size and weight, and thus the cost, of the die and punch members are substantially reduced due to the omission of a side wall portion.

Reference is now made to FIG. 11, which illustrates a further alternative punch assembly construction, which is similar to that shown in FIG. 10 in that guide member 42 is of plate-like construction and second constraint 58 is formed integrally with or otherwise connected to a rigid side wall portion 76. On the other hand, mounting member 70 is similar to the mounting member of FIG. 6, except that only one opening 88 is shown as communicating with recess 86. This construction differs from those previously described in that the punch element is formed with axially aligned punch tip portions 40 and 40′ projecting in opposite directions from head portion 38, and the lower end of driver 64 is formed with an axially extending clearance opening 240 sized to loosely and alternatively receive the punch tip portions. It is contemplated that the punch element shown in FIG. 11 may be of one-piece construction, or if desired, be of the two-part construction shown in FIG. 12, wherein the punch element is formed with a mounting recess 224 arranged equidistant from punch tip portions 40 and 40′ in the manner previously discussed with reference to FIG. 10 and a head portion 38 defined for instance by a resiliently deformable C-shaped ring snap fitted with such mounting recess. Thus, punch element 36 of FIG. 10 may be alternatively mounted within the punch assembly of FIG. 11 by fitting same with a separately formed head portion 38.

Figure 13:
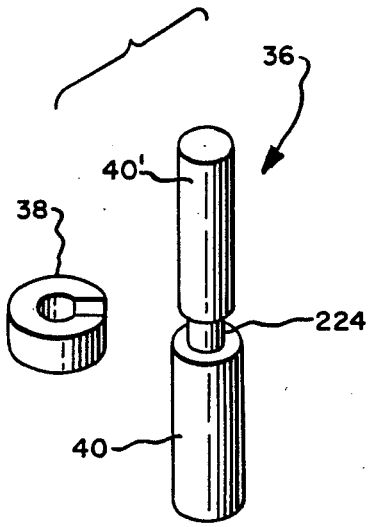
FIG. 13 is an exploded perspective view of a further modified punch element.

FIG. 13 illustrates a further proposed construction of punch element 36, which differs from those previously described with reference to FIGS. 4, 5 and 10–12 in that opposite punch tip portions 40 and 40′ differ from one another, so as to allow a single punch element to be employed in the punching of differently sized and/or differently configured holes. It is contemplated that the punch element shown in FIG. 13 will be of two-part construction, wherein punch element 36 is formed with a mounting recess 224 and a separate head portion 38 fitted within such recess in the same manner as previously described with reference to FIG. 12, but if desired, the punch element may be of one-piece construction. It is also contemplated that this construction will principally employ differently sized punch tip portions of like cross-sectional configuration, as will permit the marketing of kits wherein two differently sized sets of guide and die members would be provided for each punch element, so as to allow such punch element to be alternatively used with such sets. It will be understood that the concept of forming a punch element with a pair of oppositely facing punch tip portions of different construction is applicable to each of the punch elements shown in FIGS. 4, 8, 10, 11 and 12.

Figure 14:
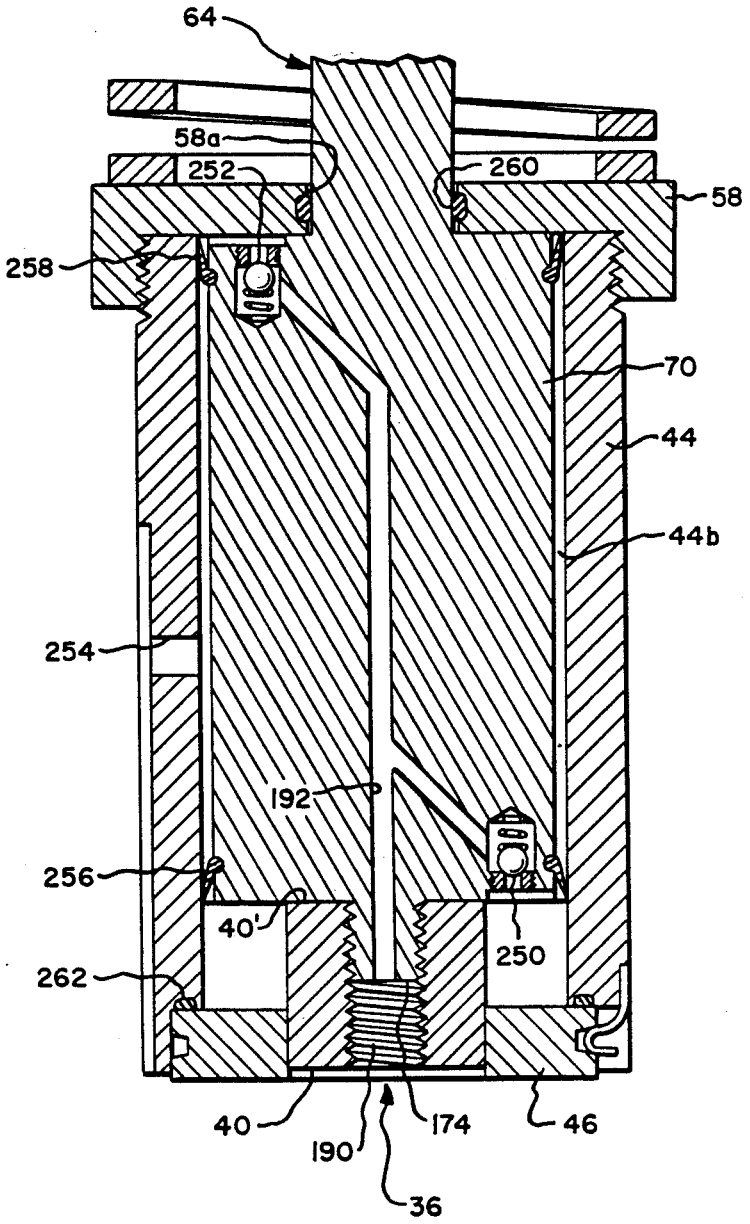
FIG. 14 is a view similar to FIG. 5, but showing a further modified construction.

FIG. 14 illustrates a modified form of the punch assembly shown in FIG. 5, which is adapted to establish a positive pressure at the punching end of punch element 36, during both the punching and stripping strokes thereof. In this construction, passage 192 is alternatively placed in flow communication with the unoccupied portions of the lower and upper ends of cavity **44*b* by suitable one-way valve means, such as may be defined by spring biased ball type check valves 250 and 252, respectively., guide wall portion 44 is provided with an air inlet opening 254; the lower and upper ends of punch driver lower end 70 are fitted with one-way valves, such as may be defined by resiliently deformable, annular flap valves 256 and 258, respectively; end wall aperture 58*a* is fitted with an O-ring seal 260; and an O-ring compression seal 262 is clamped between end wall portion 46 and side wall portion 44. In operation, downwardly directed, punching movement of driver 64 serves to reduce the volume of the lower end of cavity 44*b* as the volume of its upper end is increased. The resultant increase in pressure within the lower end of cavity 44*b* serves to unseat or open check valve 250 and supply air in excess of atmospheric pressure to the punching end of punch element 36 via passages 190 and 192. In that the pressure existing within the lower end of cavity 44*b* exceeds atmospheric pressure, during this portion of the stroke, valve 256 is maintained in fluid sealing engagement with the inner wall surface of side wall portion 44, in order to block flow communication between such lower end and air inlet opening 254. The resultant decrease in pressure within the upper end of cavity 44*b*, acts to unseat valve 258 from fluid sealing engagement with side wall portion 44, so as to place such upper end in flow communication with air inlet opening 254, and assists in maintaining valve 252** in seated or closed condition.

During upwardly directed, stripping movement of driver 64, the volumes of the lower and upper ends of cavity **44*b* increase and decrease, respectively. As a result, air within the upper end of cavity 44*b* is pressurized and valve 252 thereby unseated in order to permit the supply of air in excess of atmospheric pressure to the punching end of punch element 36. On the other hand, as the size of the lower end of cavity 44*b* is increased, the resultant reduction in pressure therewithin results in valve 256 being unseated so as to afford flow communication between the lower end of the cavity and air inlet 254. While the illustrated construction is preferred, since it serves to establish a positive pressure condition adjacent the punching end of punch element 36, during both its punching and stripping strokes, it is contemplated that an efficiently functioning unit for slug pull out prevention purposes may be achieved by connecting passage 192 only to the upper end of cavity 44*a*, so as to establish a positive pressure at punch element 36** only during the stripping stroke thereof.

The term "loosely", as used with reference to the connection between the punch drivers and the punch elements of FIGS. 3, 6, 7, 8, 10 and 11 is meant to indicate that the punch elements are sufficiently free to move or shift transversely of the punch drivers as required to permit receipt of the punch elements within the guide openings of the guide members, when there is a lack of concentricity between the punch driver and guide member and/or lack of concentricity between the head and shank portions of the punch elements, thereby to permit the guide member to function as the guide for the punch elements without interference on the part of the punch driver. It is anticipated that there will be a greater degree of looseness in a transverse direction than in a direction extending vertically or lengthwise of the punch assemblies, since it is desirable to limit to a minimum the extent of relative axial movement, which can occur between the punch elements and their drivers during the punching and stripping operations. In like manner, the term "loosely", as used with reference to the receipt of the punch drivers within the cavities of the guide members, is meant to indicate that the punch drivers are not guided by the guide members due to a close sliding fit of the type required to be provided between the guide members and the punching tips of the punch elements. A loose fit between punch drivers and guide members is desirable to insure that the punch elements are guided or otherwise constrained only by the guide members at a point immediately adjacent the point at which punching occurs.

What is claimed is:

1. In a punch mechanism for punching a slug from a workpiece and comprising a punch means having a punch end, die means having a die opening, said punch means and said die means being relatively movable for driving said punch end through said workpiece and into said die opening for creating said slug, said guide means for aligning said punch end and said die opening during relative movement of said punch means and said die means, the improvement for reducing the tendency for said slug to be pulled out of said die opening during withdrawal of said punch end from within said die opening, due to a vacuum condition tending to be created at the interface of said punch end and said slug, which comprises:

fluid passage means extending through said punch end for placing said interface in flow communication with fluid source means disposed remotely of said punch end, and said fluid source means tends to reduce the occurrence of said vacuum condition, said guide means defines a cavity for movably receiving a portion of said punch means, said fluid source means is defined at least in part by a portion of said cavity unoccupied by said punch means, said unoccupied portion of said cavity is increased and reduced in size incident to said driving and withdrawal of said punch end relative to said die opening, respectively, one-way valve means is provided for placing said unoccupied portion of said cavity in flow communication with the atmosphere while being increased in size, and said fluid passage means includes one-way valve means for placing said interface in flow communication with said unoccupied portion of said cavity while being reduced in size.

2. In a punch mechanism for punching a slug from a workpiece and comprising a punch means having a punch end, die means having a die opening, said punch means and said die means being relatively movable for driving said punch end through said workpiece and into said die opening for creating said slug, and guide means for aligning said punch end and said die opening during relative movement of said punch and said die means, the improvement for reducing the tendency for said slug to be pulled out of said die opening during withdrawal of said punch end from within said die opening, due to a vacuum condition tending to be created at the interface of said punch end and said slug, which comprises:

fluid passage means extending through said punch end for placing said interface in flow communication with fluid source means disposed remotely of said punch end, and said fluid source means tends to reduce the occurrence of said vacuum condition, said punch means includes a punch driver having a mounting end portion and a punch element defining said punch end and having an opposite end removably fixed to said mounting end portion, said guide means defines a cavity movably receiving said mounting end portion and said opposite end, said fluid source means is defined at least in part by a portion of said cavity unoccupied by said mounting end portion and said opposite end, and said fluid passage means extends through said punch element and said mounting end portion and communicates with said unoccupied portion of said cavity, said opposite end of said punch element defines a second punch end of said punch element, said punch element is formed with a mounting opening extending through said ends thereof, said mounting opening defines a portion of said fluid passage means, and said mounting end portion is removably fixed within opposite ends of said mounting opening to alternatively position said punch end and said second punch end for receipt within said die opening.

3. In a punch mechanism for punching a slug from a workpiece and comprising a punch means having a punch end, die means having a die opening, said punch means and said die means being relatively movable for driving said punch end through said workpiece and into said die opening for creating said slug, and guide means for aligning said punch end and said die opening during relative movement of said punch means and said die means, the improvement for reducing the tendency for said slug to be pulled out of said die opening during withdrawal of said punch end from within said die opening, due to a vacuum condition tending to be created at the interface of said punch end and said slug by establishing a positive pressure at said interface during said withdrawal of said punch end, which comprises:

said guide means defines a cavity for movably receiving a portion of said punch means and cooperating therewith to define a portion of said cavity unoccupied by said punch means which is increased and reduced in size incident to said driving and withdrawal of said punch end relative to said die opening, respectively;

fluid passage means extending through said punch end for placing said interface in flow communication with fluid source means via said portion of said cavity; and valve means within said fluid passage means for blocking flow communication between said portion of said cavity and said source means during said withdrawal of said punch end to effect an increase in positive pressure within said portion of said cavity incident to said reduction in size thereof.

4. An improvement according to claim 3, wherein said guide means cooperates with said punch means to define another portion of said cavity which is reduced and increased in size incident to said driving and withdrawal of said punch end relative to said die opening, respectively, said fluid passage means further places said interface in flow communication with said fluid source means via said other portion of said cavity, and further valve means are provided for blocking flow communication between said other portion of said cavity and said source means during said driving of said punch end.

5. An improvement according to claim 4, wherein said valve means includes a one-way valve for blocking flow from said interface to said portion of said cavity incident to said driving of said punch end and a one-way valve for blocking flow from said portion of said cavity to said fluid source means incident to said withdrawal of said punch end, and said further valve means includes a one-way valve for blocking flow from said interface to said other portion of said cavity incident to said withdrawal of said punch end and a one-way valve for blocking flow from said other portion of said cavity to said flow source means incident to said driving of said punch end, and said fluid source means is the atmosphere.

* * * * *

UNITED STATES PATENT AND TRADEMARK OFFICE

CERTIFICATE OF CORRECTION

PATENT NO. : 4,947,716

DATED : August 14, 1990

INVENTOR(S) : S. Arthur Whistler

It is certified that error appears in the above-identified patent and that said Letters Patent is hereby corrected as shown below:

Col. 1, line 30 - "2,393,962" should be ---2,373,962---.

Col. 5, line 46 - after "punch assembly 12", insert ---is positionally located relative to punch templet 16 by receipt---.

Col. 12, line 45 - "said guide" should be ---and guide---.

Signed and Sealed this

Twenty-eighth Day of January, 1992

*Attest:*

HARRY F. MANBECK, JR.

*Attesting Officer*

*Commissioner of Patents and Trademarks*